US009698469B2

(12) United States Patent
Lin

(10) Patent No.: US 9,698,469 B2
(45) Date of Patent: Jul. 4, 2017

(54) ANTENNA STRUCTURE AND WIRELESS COMMUNICATION DEVICE USING THE SAME

(71) Applicant: Chiun Mai Communication Systems, Inc., New Taipei (TW)

(72) Inventor: Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 328 days.

(21) Appl. No.: 14/295,511

(22) Filed: Jun. 4, 2014

(65) Prior Publication Data

US 2014/0361929 A1 Dec. 11, 2014

(30) Foreign Application Priority Data

Jun. 6, 2013 (TW) ..... 102120137 A

(51) Int. Cl.

| | |
|---|---|
| ***H01Q 1/38*** | (2006.01) |
| ***H01Q 1/24*** | (2006.01) |
| ***H01Q 9/42*** | (2006.01) |
| ***H01Q 5/392*** | (2015.01) |

(52) U.S. Cl.
CPC ..... *H01Q 1/243* (2013.01); *H01Q 5/392* (2015.01); *H01Q 9/42* (2013.01)

(58) Field of Classification Search
CPC ..... H01Q 1/38; H01Q 9/0407; H01Q 9/0421; H01Q 1/243; H01Q 5/0003
USPC ..... 343/700 MS, 702, 906
See application file for complete search history.

(56) References Cited

U.S. PATENT DOCUMENTS

| | | | | |
|---|---|---|---|---|
| 8,154,470 | B2 * | 4/2012 | Chang | H01Q 1/22 343/700 MS |
| 8,531,348 | B2 * | 9/2013 | Wu | H01Q 1/243 343/700 MS |
| 9,112,274 | B2 * | 8/2015 | Cheng | H01Q 9/42 |
| 2009/0167631 | A1 * | 7/2009 | Tai | H01Q 1/22 343/906 |
| 2010/0156741 | A1 * | 6/2010 | Vazquez | H01Q 1/2291 343/702 |
| 2010/0315297 | A1 * | 12/2010 | Wu | H01Q 1/2275 343/702 |
| 2011/0095963 | A1 * | 4/2011 | Wu | H01Q 1/243 343/906 |
| 2012/0106036 | A1 * | 5/2012 | Kao | G06F 1/1698 361/679.01 |
| 2013/0241797 | A1 * | 9/2013 | Kuo | H01Q 1/243 343/876 |
| 2014/0097997 | A1 * | 4/2014 | Chang | H01Q 1/22 343/846 |

(Continued)

FOREIGN PATENT DOCUMENTS

| | | |
|---|---|---|
| CN | 102739823 A | 10/2012 |
| CN | 202797257 U | 3/2013 |

(Continued)

*Primary Examiner* — Huedung Mancuso
(74) *Attorney, Agent, or Firm* — Steven Reiss

(57) ABSTRACT

An antenna structure includes a metal member, a first antenna, and a second antenna. The second antenna includes a first portion, a second portion, and a third portion. Both of the second portion and the third portion are connected to the first portion. Both of the first portion and the third portion are spaced from the first antenna, and are coupled with the metal member.

13 Claims, 5 Drawing Sheets

(56) References Cited

U.S. PATENT DOCUMENTS

| | | | | |
|---|---|---|---|---|
| 2014/0292584 | A1* | 10/2014 | Lin | H01Q 1/243 343/700 MS |
| 2014/0354487 | A1* | 12/2014 | Liang | H01Q 1/243 343/702 |

FOREIGN PATENT DOCUMENTS

| | | | |
|---|---|---|---|
| TW | I393289 | A | 7/2009 |
| TW | 201251195 | A | 12/2012 |

* cited by examiner

ANTENNA STRUCTURE AND WIRELESS COMMUNICATION DEVICE USING THE SAME

FIELD

The disclosure generally relates to antenna structures, and particularly to an antenna structure having a metallic housing, and a wireless communication device using the same.

BACKGROUND

Antennas are used in wireless communication devices such as mobile phones. The wireless communication device uses a multiband antenna to receive/transmit wireless signals at different frequencies.

BRIEF DESCRIPTION OF THE DRAWINGS

Many aspects of the present disclosure can be better understood with reference to the drawings. The components in the drawings are not necessarily drawn to scale, the emphasis instead being placed upon clearly illustrating the principles of the disclosure. Moreover, in the drawings, like reference numerals designate corresponding parts throughout the views.

DETAILED DESCRIPTION

The present disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

Figure 1:
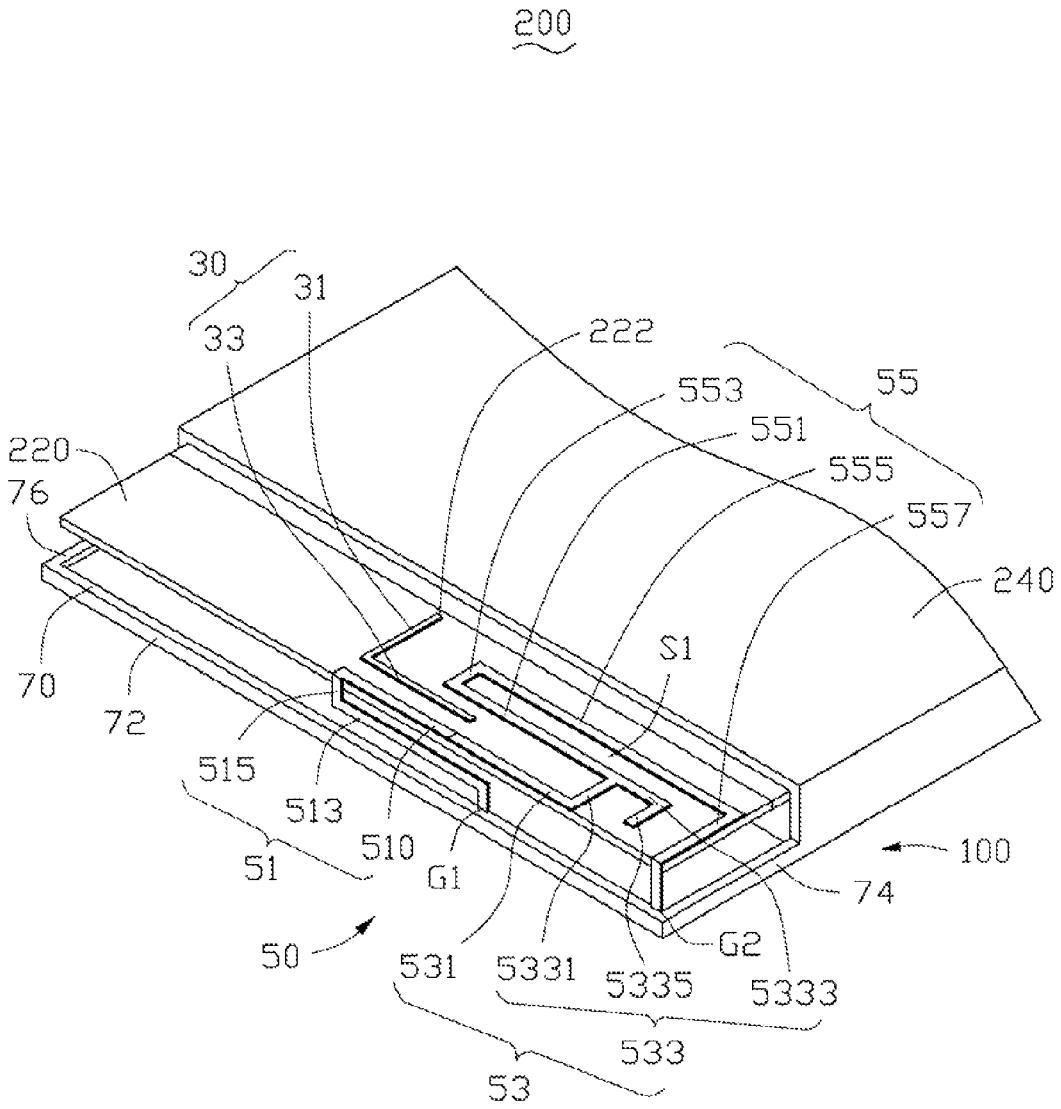
FIG. 1 is an isometric view of a wireless communication device employing an antenna structure, according to a first exemplary embodiment.

FIG. 1 illustrates an embodiment of a wireless communication device 200 employing an antenna structure 100, according to a first exemplary embodiment. The wireless communication device 200 can be a mobile phone or a tablet, for example (details not shown).

The wireless communication device 200 includes a printed circuit board (PCB) 220 and a metallic housing 240. The PCB forms a feed pin 222 and a ground pin (not shown). The feed pin 222 provides current for the antenna structure 100. The PCB 220 is received in the metallic housing 240, and the metallic housing 240 is fixed to the PCB 220 to couple with the ground pin. Thus, the antenna structure 100 can be grounded by the metallic housing 240.

The antenna structure 100 includes a first antenna 30, a second antenna 50, and a metal member 70. Both the first antenna 30 and the second antenna 50 are positioned on the PCB 220. The metal member 70 is integrated with the metallic housing 240. The first antenna 30 is coupled with the feed pin 222, the second antenna 50 is spaced from the first antenna 30, and is connected to the metal member 70.

The first antenna 30 includes a first extending section 31 and a second extending section 33 substantially coplanar with the first extending section 31. A first end of the first extending section 31 is electronically connected to the feed pin 222, and a second end of the first extending section 31 is substantially perpendicular to the second extending section 33.

The second antenna 50 includes a first portion 51, a second portion 53, and a third portion 55. The first portion 51 includes a first strip 510 and a second strip 513 spaced from the first strip 510, and a connection strip 515 is connected between the first strip 510 and the second strip 513. A plane of the first strip 510 is substantially perpendicular to a plane of the second strip 513. A distal end of the second strip 513 is connected to the metal member 70.

The second portion 53 includes a first connection section 531 and a second connection section 533. The first connection section 531 extends continuously from the first strip 510. The second connection section 533 is substantially a U-shaped sheet, and includes a first connection sheet 5331, a second connection sheet 5333, and a third connection sheet 5335. The first connection sheet 5331 is connected substantially perpendicular to the first connection section 531. The second connection sheet 5333 is perpendicularly connected between the first connection sheet 5331 and the third connection sheet 5335.

The third portion 55 includes a first extending sheet 551, a second extending sheet 553, a third extending sheet 555, and a fourth extending sheet 557. The first extending sheet 551 extends continuously from the second connection sheet 5333, and is spaced from the third extending sheet 555. The second extending sheet 553 is perpendicularly connected between the first extending sheet 551 and the third extending sheet 555. Thus, a first slot S1 is defined among the first extending sheet 551, the second extending sheet 553, and the third extending sheet 555. The fourth extending sheet 557 is connected substantially perpendicular to the third extending sheet 555, and is parallel to the third connection sheet 5335. A distal end of the fourth extending sheet 557 is connected to the metal member 70.

The metal member 70 can be a metallic frame of the wireless communication device 200. In the first exemplary embodiment, the metal member 70 includes a first beam 72, a second beam 74, and a third beam 76. The second beam 74 and the third beam 76 are respectively connected to two opposite sides of the first beam 72, and are integrated with the metallic housing 240. The second strip 513 is connected to a middle portion of the first beam 72 to form a first junction G1, for example, the second strip 513 is connected to the first beam 72 via an elastic sheet (not shown). The fourth extending sheet 557 is connected to an end of the first beam 72 adjacent to the second beam 74, to form a second junction G2, for example, the fourth extending sheet 557 is welded to the first beam 72.

Figure 2:
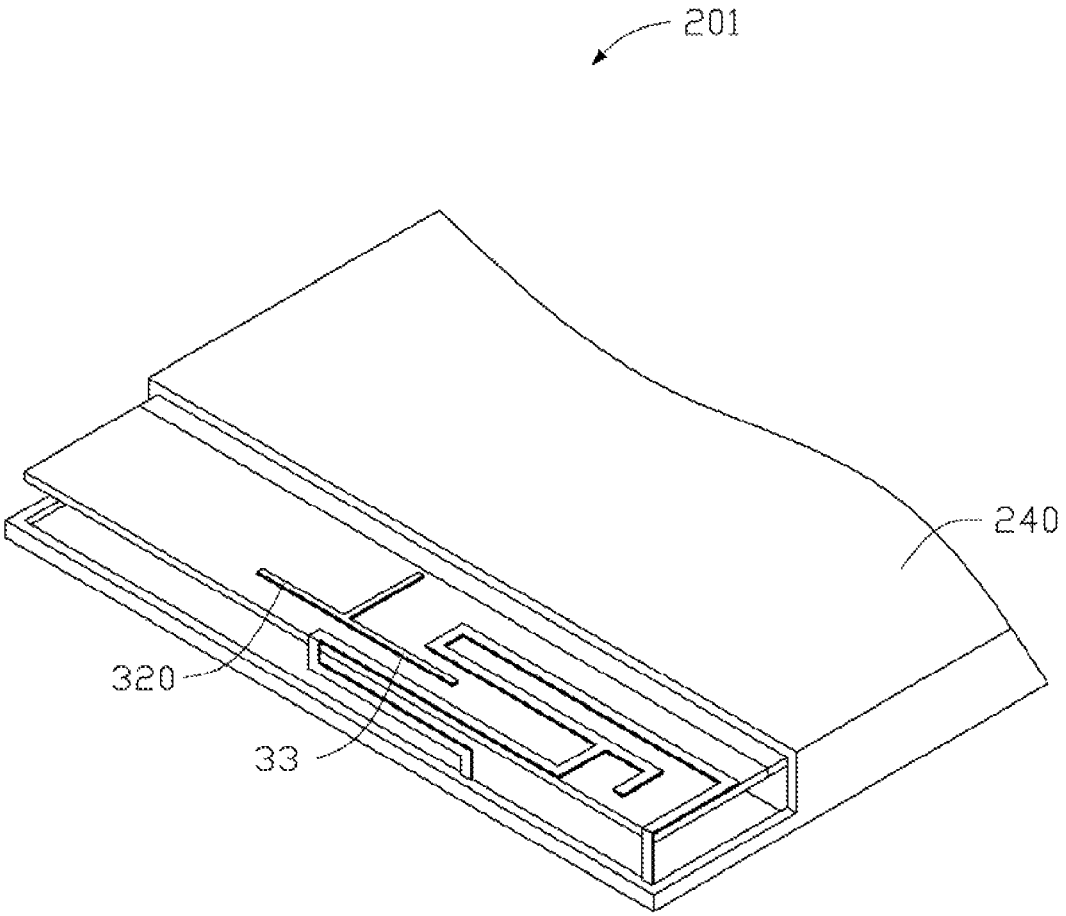
FIG. 2 is an isometric view of a wireless communication device employing an antenna structure, according to a second exemplary embodiment.

FIG. 2 illustrates a wireless communication device 201, according to a second exemplary embodiment. A difference between the wireless communication device 201 of the second exemplary embodiment and the wireless communication device 200 of the first exemplary embodiment is that a radiation section 320 extends continuously from the second extending section 33.

Figure 3:
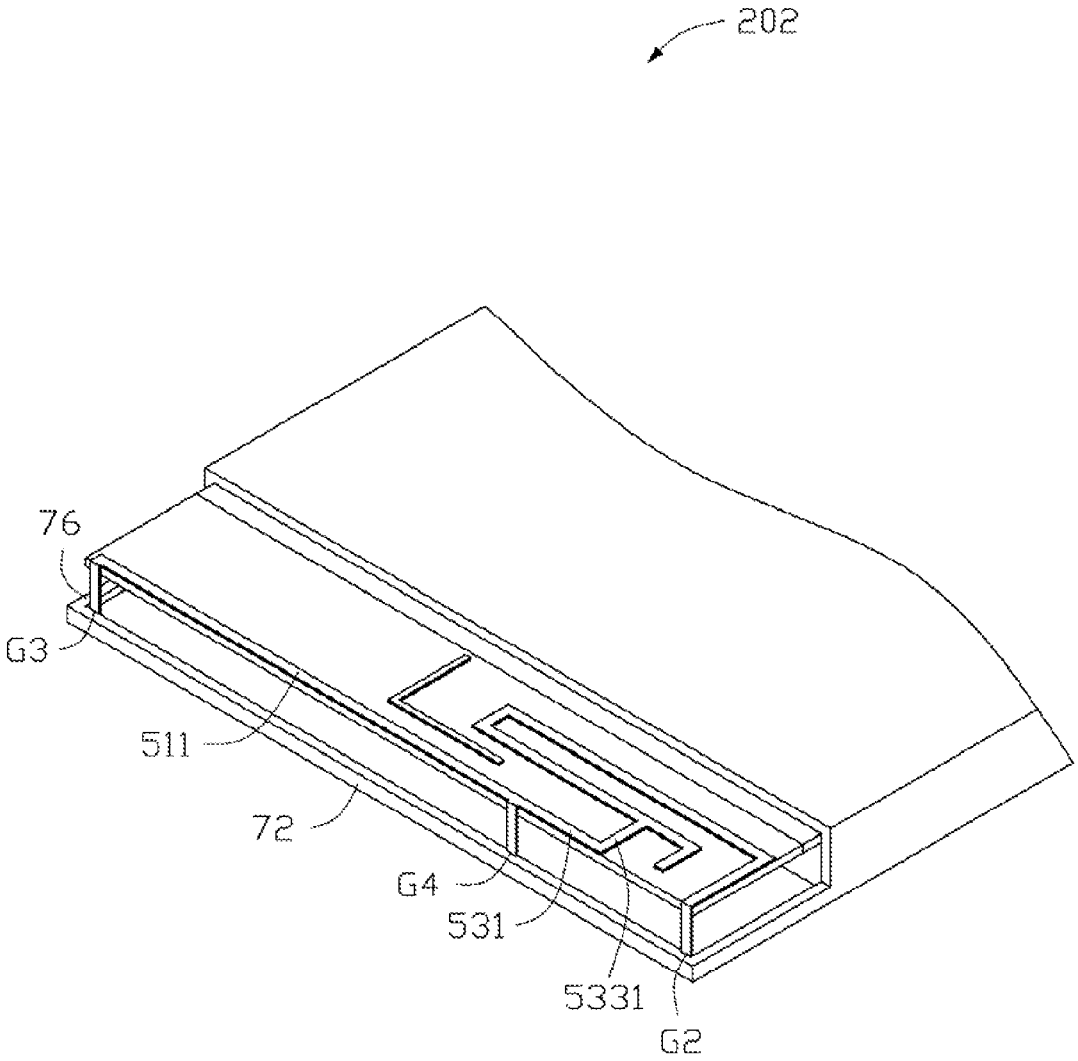
FIG. 3 is an isometric view of a wireless communication device employing an antenna structure, according to a third exemplary embodiment.

FIG. 3 illustrates a wireless communication device 202, according to a third exemplary embodiment. A difference between the wireless communication device 202 of the third exemplary embodiment and the wireless communication device 200 of the first exemplary embodiment is that a coupling sheet 511 of the wireless communication device 202 replaces the first portion 51 of the wireless communication device 200. The coupling sheet 511 extends continuously from the first connection section 531, and is parallel to the second extending section 33. A distal end of the coupling sheet 511 is connected to an end of the first beam 72 adjacent to the third beam 76, to form a third junction G3. A junction of the coupling sheet 511 and the first connection section 531 is connected to the first beam 72 to form a fourth junction G4.

Figure 4:
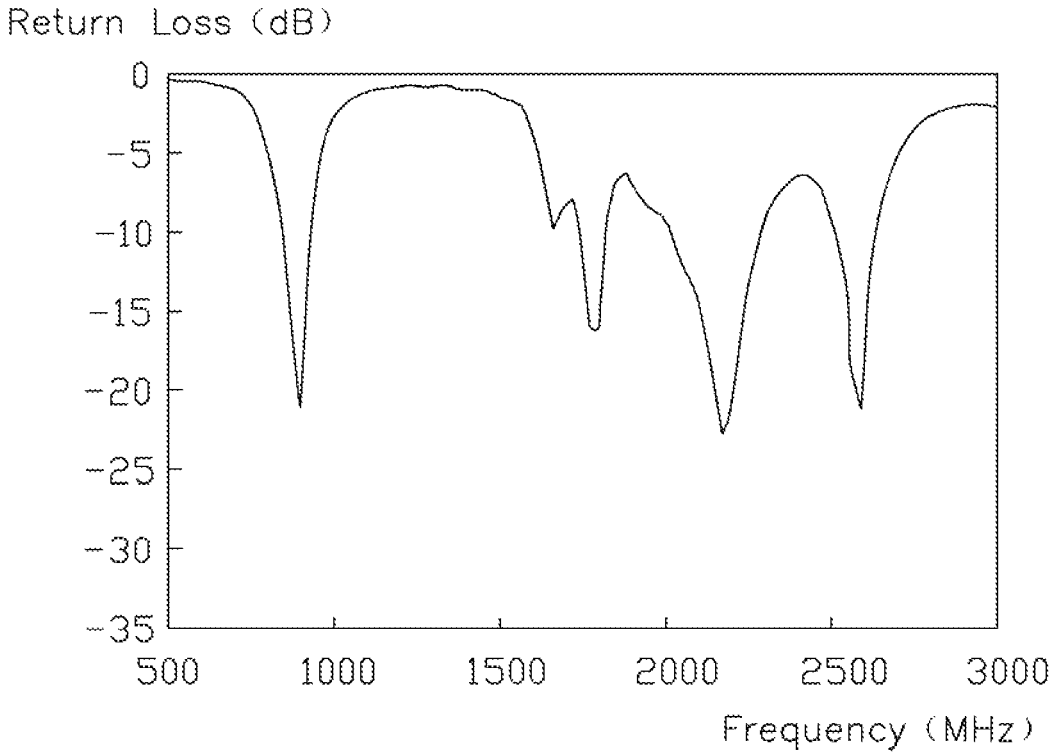
FIG. 4 is a return loss (RL) graph of the antenna structure of FIG. 1.
Figure 5:
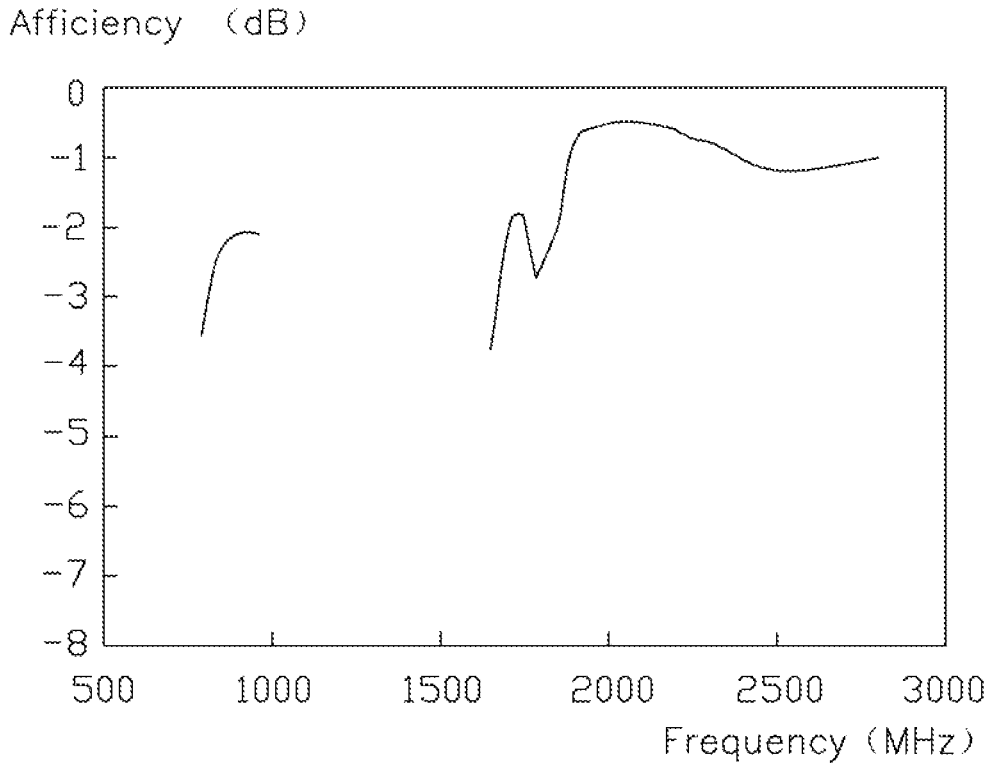
FIG. 5 is an antenna efficiency graph of the antenna structure of FIG. 1.

When current is input to the first antenna 30, the current flows to the first extending section 31 and the second extending section 33 to form a first current path. Additionally, the current is coupled from the first antenna 30 to the first portion 51 of the second antenna 50. Thus, a first portion of the current flows to the first strip 510, the second strip 513, the first beam 72, and the third beam 76, and then is grounded via the metallic housing 240 to form a second current path. A second portion of the current flows to the first connection section 531, the second connection section 533, the forth extending sheet 557, the second beam 74, and then is grounded via the metallic housing 240 to form a third current path. Furthermore, the current is coupled from the first antenna 30 to the third portion 55 of the second antenna 50, and flows to the first extending sheet 551, the second extending sheet 553, the third extending sheet 555, the fourth extending sheet 557, the second beam 74, and then is grounded via the metallic housing 240 to form a fourth current path. Thus, the antenna structure 100 can receive and transmit wireless signals at a plurality of bandwidths, which can be for example about 824-960 MHZ or 1710-2690 MHZ. FIG. 4 illustrates a return loss (RL) graph of the antenna structure 100 of FIG. 1, and FIG. 5 illustrates an antenna efficiency graph of the antenna structure 100 of FIG. 1. The antenna structure 100 has good performance when operating at bandwidths of 824-960 MHZ and 1710-2690 MHZ.

In summary, the metal member 70 serves as a part of the antenna structure 100. Thus, the wireless communication device 200, 201, 202 does not need any additional antennas, which can effectively utilize a space of the wireless communication device 200, 201, 202. In addition, electromagnetic interference between the metallic housing and the antenna structure 100 is reduced and a radiating capability of the antenna structure 100 of the wireless communication device 200, 201, 202 is effectively improved.

It is to be understood, however, that even through numerous characteristics and advantages of the present disclosure have been set forth in the foregoing description, together with details of assembly and function, the disclosure is illustrative only, and changes may be made in detail, especially in the matters of shape, size, and arrangement of parts within the principles of the disclosure to the full extent indicated by the broad general meaning of the terms in which the appended claims are expressed.

What is claimed is:

1. An antenna structure, comprising:

a metal member, wherein the metal member comprises a first beam, a second beam, a third beam, the second beam and the third beam are respectively connected to two opposite sides of the first beam;

a first antenna; and a second antenna comprising a first portion, a second portion, and a third portion, both of the second portion and the third portion connected to the first portion, both of the first portion and the third portion spaced from the first antenna; and both of the first portion and the third portion coupled with the first beam of the metal member;

wherein the first antenna comprises a first extending section and a second extending section coplanar with the first extending section, and the second extending section is perpendicular to the first extending section;

wherein the first portion comprises a first strip and a second strip spaced from the first strip, and a connection strip is connected between the first strip and the second strip, a plane of the first strip is perpendicular to a plane of the second strip, a distal end of the second strip is connected to the metal member;

wherein the second portion comprises a first connection section and a second connection section, the first connection section extends continuously from the first strip, the second connection section comprises a first connection sheet, a second connection sheet, and a third connection sheet, the first connection sheet is perpendicularly connected to the first connection section, the second connection sheet is perpendicularly connected between the first connection sheet and the third connection sheet.

2. The antenna structure as claimed in claim 1, wherein the third portion comprises a first extending sheet, a second extending sheet, a third extending sheet, and a fourth extending sheet, the first extending sheet extends continuously from the second connection sheet, and is spaced from the third extending sheet, the second extending sheet is perpendicularly connected between the first extending sheet and the third extending sheet, the fourth extending sheet is perpendicularly connected to the third extending sheet, and is parallel to the third connection sheet, a distal end of the fourth extending sheet is connected to the metal member.

3. The antenna structure as claimed in claim 1, wherein the first antenna further comprises a radiation section extending continuously from the second extending section.

4. The antenna structure as claimed in claim 1, further comprising a coupling sheet extending continuously from the second portion, and parallel to the second extending section, wherein a distal end of the coupling sheet is connected to the metal member.

5. The antenna structure as claimed in claim 2, wherein the second strip is connected to the first beam, the fourth extending sheet is connected to an end of the first beam.

6. A wireless communication device, comprising:

a metallic housing;

an antenna structure comprising:

a metal member connected to the metallic housing, wherein the metal member comprises a first beam, a second beam, a third beam, the second beam and the third beam are respectively connected to two opposite sides of the first beam;

a first antenna; and a second antenna comprising a first portion, a second portion, and a third portion, both of the second portion and the third portion connected to the first portion, both of the first portion and the third portion spaced from the first antenna; and both of the first portion and the third portion coupled with the first beam of the metal member;

wherein the first antenna comprises a first extending section and a second extending section coplanar with the first extending section, and the second extending section is perpendicular to the first extending section;

wherein the first portion comprises a first strip and a second strip spaced from the first strip, and a connection strip is connected between the first strip and the second strip, a plane of the first strip is perpendicular to a plane of the second strip, a distal end of the second strip is connected to the metal member;

wherein the second portion comprises a first connection section and a second connection section, the first connection section extends continuously from the first strip, the second connection section comprises a first connection sheet, a second connection sheet, and a third connection sheet, the first connection sheet is perpendicularly connected to the first connection section, the second connection sheet is perpendicularly connected between the first connection sheet and the third connection sheet.

7. The wireless communication device as claimed in claim 6, wherein the third portion comprises a first extending sheet, a second extending sheet, a third extending sheet, and a fourth extending sheet, the first extending sheet extends continuously from the second connection sheet, and is spaced from the third extending sheet, the second extending sheet is perpendicularly connected between the first extending sheet and the third extending sheet, the fourth extending sheet is perpendicularly connected to the third extending sheet, and is parallel to the third connection sheet, a distal end of the fourth extending sheet is connected to the metal member.

8. The wireless communication device as claimed in claim 6, wherein the first antenna further comprises a radiation section extending continuously from the second extending section.

9. The wireless communication device as claimed in claim 6, further comprising a coupling sheet extending continuously from the second portion, and parallel to the second extending section, wherein a distal end of the coupling sheet is connected to the metal member.

10. The wireless communication device as claimed in claim 7, wherein the first, second and third beams are integrated with the metallic housing, the second strip is connected to the first beam, the fourth extending sheet is connected to an end of the first beam.

11. A wireless communication device, comprising:

a metallic housing;

an antenna structure comprising:

a metal member connected to the metallic housing;

a first antenna spaced from the metal member; and a second antenna comprising a first portion, a second portion, and a third portion, both of the second portion and the third portion connected to the first portion, both of the first portion and the third portion spaced from the first antenna; and both of the first portion and the third portion coupled with of the metal member;

wherein the first portion comprises a first strip and a second strip spaced from the first strip, and a connection strip is connected between the first strip and the second strip, a plane of the first strip is perpendicular to a plane of the second strip, a distal end of the second strip is connected to the metal member, the second portion comprises a first connection section and a second connection section, the first connection section extends continuously from the first strip, the second connection section comprises a first connection sheet, a second connection sheet, and a third connection sheet, the first connection sheet is perpendicularly connected to the first connection section, the second connection sheet is perpendicularly connected between the first connection sheet and the third connection sheet.

12. The wireless communication device as claimed in claim 11, wherein the metal member comprises a first beam, a second beam, a third beam, the second beam and the third beam are respectively connected to two opposite sides of the first beam.

13. The wireless communication device as claimed in claim 11, wherein the third portion comprises a first extending sheet, a second extending sheet, a third extending sheet, and a fourth extending sheet, the first extending sheet extends continuously from the second connection sheet, and is spaced from the third extending sheet, the second extending sheet is perpendicularly connected between the first extending sheet and the third extending sheet, the fourth extending sheet is perpendicularly connected to the third extending sheet, and is parallel to the third connection sheet, a distal end of the fourth extending sheet is connected to the metal member.

* * * * *